US005770554A

United States Patent [19]

Misselyn et al.

[11] Patent Number: 5,770,554

[45] Date of Patent: Jun. 23, 1998

[54] LIQUID CLEANING COMPOSITIONS

[75] Inventors: Anne-Marie Misselyn, Villers-l'eveque; Patrick Durbut, Verviers; Guy Broze, Grace-Hollogne, all of Belgium

[73] Assignee: Colgate-Palmolive Co., Piscataway, N.J.

[21] Appl. No.: 677,291

[22] Filed: Jul. 9, 1996

Related U.S. Application Data

[60] Provisional application No. 60/001,306 Jul. 20, 1995.

[51] Int. Cl. [6] ..... C11D 3/37; C11D 3/04; C11D 3/12; C11D 1/02

[52] U.S. Cl. ..... 510/426; 510/427; 510/428; 510/109; 510/191; 510/215; 510/217; 510/238; 510/365

[58] Field of Search ..... 510/417, 426, 510/427, 428, 109, 191, 215, 217, 238, 365

[56] References Cited

U.S. PATENT DOCUMENTS

| | | | |
|---|---|---|---|
| 5,486,307 | 1/1996 | Misselyn et al. | 252/174.24 |
| 5,531,938 | 7/1996 | Erilli | 510/417 |
| 5,536,450 | 7/1996 | Masters et al. | 510/417 |
| 5,616,781 | 4/1997 | Sajic et al. | 510/221 |
| 5,629,279 | 5/1997 | Erilli et al. | 510/237 |
| 5,641,742 | 6/1997 | Adamy et al. | 510/500 |

*Primary Examiner*—Matthew V. Grumbling
*Attorney, Agent, or Firm*—Richard Nanfeldt; James M. Serafino

[57] ABSTRACT

All purpose cleaning or microemulsion compositions more environmentally friendly, which is especially effective in the removal of a mixture of oil and kaolin soil, contains an analephotropic negatively charged complex, a hydrocarbon ingredient, a cosurfactant, and water.

16 Claims, No Drawings

LIQUID CLEANING COMPOSITIONS

This application claims priority under 35 U.S.C. §119(e) from provisional application 60/001,306, filed Jul. 20, 1995.

FIELD OF THE INVENTION

The present invention relates to a hard surface cleaning composition containing an analephotropic negatively charged complex.

BACKGROUND OF THE INVENTION

This invention relates to an improved all-purpose liquid cleaner designed in particular for cleaning hard surfaces and which is effective in removing grease soil and/or bath soil and in leaving unrinsed surfaces with a shiny appearance.

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surfaced or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of 25 to 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616 - Herbots et al; European Patent Application EP 0160762 - Johnston et al; and U.S. Pat. No. 4,561,991 - Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to 18% by weight of the aqueous phase), the presence of such high quantities of grease-removal solvent tend to reduce the total amount of greasy or oily soils which can be taken up by and into the microemulsion without causing phase separation.

The following representative prior art patents also relate to liquid detergent cleaning compositions in the form of o/w microemulsions: U.S. Pat. Nos. 4,472,291 - Rosario; 4,540,448 - Gauteer et al; 3,723,330 - Sheflin; etc.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; 4,414,128; and 4,540,505. For example, U.S. Pat. No. 4,414,128 broadly discloses an aqueous liquid detergent composition characterized by, by weight:

(a) from 1% to 20% of a synthetic anionic, nonionic, amphoteric or zwitterionic surfactant or mixture thereof;

(b) from 0.5% to 10% of a mono- or sesquiterpene or mixture thereof, at a weight ratio of (a):(b) being in the range of 5:1 to 1:3; and (c ) from 0.5% 10% of a polar solvent having a solubility in water at 15° C. in the range of from 0.2% to 10%. Other ingredients present in the formulations disclosed in this patent include from 0.05% to 2% by weight of an alkali metal, ammonium or alkanolammonium soap of a $C_{13}$–$C_{24}$ fatty acid; a calcium sequestrant from 0.5% to 13% by weight; non-aqueous solvent, e.g., alcohols and glycol ethers, up to 10% by weight; and hydrotropes, e.g., urea, ethanolamines, salts of lower alkylaryl sulfonates, to 10% by weight. All of the formulations shown in the Examples of this patent include relatively large amounts of detergent builder salts which are detrimental to surface shine.

A pH neutral microemulsion composition based on paraffin sulfonate and ethoxylated nonionic surfactant is able to deliver improved grease cleaning versus built, alkaline compositions. Besides the improved grease cleaning, this approach is much safer to surfaces as well as less aggressive on consumer's hands (Loth et al - U.S. Pat. No. 5,075,026).

The microemulsion technology provides outstanding oil uptake capacity because of the adjustment of the curvature of the surfactant micelles by the molecules of the cosurfactant. Rod-like micelles are preferred as they can "swallow" oil to become globular without increasing the surface of contact between the hydrophobic core of the micelle and the hydrophilic continuous phase.

In diluted usage however, the microemulsion state is usually lost and the cleaning performance relies on the adsorption efficacy and leaving character of the surfactant system. Nonionic surfactants perform very well on grease, as they are excellent grease "solubilizers". Actually, they spontaneously form swollen micelles. In moderate climate countries such as the northern states of the United States and the northern countries of Europe, the soil on the hard surfaces contains a major proportion of greasy materials. It is accordingly not surprising that the anionic-nonionic surfactant based microemulsion is so efficient in those countries. In hot weather countries however, the amount of particulate soils is more important (as doors and windows remain open) and the classical microemulsion (U.S. Pat. No. 5,075,026) shows weaknesses on this type of soil which is a mixed grease-particulate soil in nature.

The instant invention solves this problem by delivering on the solid surface to be cleaned the proper surfactant mixture that best adsorbs on the surface while keeping a good "leaving" character.

The instant invention teaches that microemulsions containing an analephotropic complex of an anionic surfactant with an amphoteric or high dipole moment surfactant deliver this desired property. The analephotropic complex adsorbs much better on grease than on silica surface than individual anionic surfactants alone. This results in enhanced capabilities to disperse complex mixtures of grease with embedded particles of soil which are essential for particulate soil removal.

As illustrated in the examples, it is essential that the analephotropic mixture is negatively charged. Pseudo-nonionic surfactants resulting from anionic-cationic complexes which are not negatively charged show very low particulate soil removal.

SUMMARY OF THE INVENTION

The present invention provides an improved, clear, liquid cleaning composition having improved interfacial tension which improves cleaning hard surfaces such as plastic, vitreous and metal surfaces having a shiny finish, oil stained floors, automative engines and other engines. More particularly, the improved cleaning compositions exhibit good grease soil removal properties due to the improved interfacial tensions and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products. The instant compositions exhibit a grease release effect in that the instant compositions impede or decrease the anchoring of greasy soil on surfaces that have been cleaned with the instant compositions as compared to surfaces cleaned with a microemulsion composition which means that the grease soiled surface is easier to clean upon subsequent cleanings.

Surprisingly, these desirable results are accomplished even in the absence of polyphosphate or other inorganic or organic detergent builder salts and also in the complete absence or substantially complete absence of grease-removal solvent.

In one aspect, the invention generally provides a stable, clear all-purpose, hard surface cleaning composition especially effective in the removal of oily and greasy oil. The cleaning composition includes, on a weight basis:

- about 3% to about 40%, more preferably about 5% to about 20% of an analephotropic negatively charged complex comprising at least one an alkali metal salt or an alkaline earth metal salt of a sulfate or sulfonate anionic surfactant and mixtures thereof being complexed with an amphoteric (zwitterionic) surfactant or a high dipole moment surfactant selected from the group consisting of amine oxides or alkylene carbonates.
- about 0 to about 50%, more preferably 1% to 20%, of a water-mixable cosurfactant having either limited ability or substantially no ability to dissolve oily or greasy soil;
- 0 to about 3.5% of a fatty acid;
- 0 to about 15% of magnesium sulfate heptahydrate;
- about 0 to about 10.0% of a perfume or water insoluble hydrocarbon; and
- the balance being water, said proportions being based upon the total weight of the composition.

The instant compositions excluded the use of ethoxylated nonionic surfactants formed for the condensation product of primary or secondary alkanols and ethylene oxide or propylene oxides because the use of these ethoxylated nonionic would cause a weakening of the chemical association between the chemical linker and anionic surfactant.

The cleaning composition can be in the form of a microemulsion in which case the concentration of the water mixable cosurfactant is about 0 to about 50 wt. %, preferably about 1 wt. % to about 20 wt. % and the concentration of the perfume or water insoluble hydrocarbon is about 0.4 wt. % to about 10.0 wt. %. The dispersed oil phase of the o/w microemulsion is composed essentially of a water-immiscible or hardly water-soluble perfume. Quite surprisingly although the perfume is not, per se, a solvent for greasy or oily soil, —even though some perfumes may, in fact, contain as much as 80% of terpenes which are known as good grease solvents—the inventive compositions in dilute form have the capacity to solubilize up to 10 times or more of the weight of the perfume of oily and greasy soil, which is removed or loosened from the hard surface by virtue of the action of the anionic surfactant, said soil being taken up into the oil phase of the o/w microemulsion.

In second aspect, the invention generally provides highly concentrated microemulsion compositions in the form of either an oil-in-water (o/w) microemulsion or a water-in-oil (w/o) microemulsion which when diluted with additional water before use can form dilute o/w microemulsion compositions. Broadly, the concentrated microemulsion compositions contain, by weight, 20% to 40% of an analephotropic negatively charged complex, 0% to 2.5% of a fatty acid, 0.4% to 10% of perfume or water insoluble hydrocarbon having 6 to 18 carbon atoms, 0 to 50% of a cosurfactant, and the balance being water.

DETAILED DESCRIPTION OF THE INVENTION

The present invention relates to a stable hard surface cleaning composition approximately by weight: 3% to 40% of an analephotropic negatively charged complex, 0 to 50% of a cosurfactant, 0 to 10% of a water insoluble hydrocarbon or a perfume and the balance being water, wherein the cleaning composition can be in the form of a microemulsion in which case the concentration of the water mixable cosurfactant is about 0 to about 50.0 wt. %, preferably about 0.1 wt. % to about 50.0 wt. % and the concentration of the perfume or water insoluble hydrocarbon is about 0.4 wt. % to about 10.0 wt. %.

The instant compositions excluded the use of ethoxylated nonionic surfactants formed for the condensation product of primary or secondary alkanols and ethylene oxide or propylene oxides because the use of these ethoxylated nonionic would cause a weakening of the chemical association between the chemical linker and anionic surfactant.

One of the objects of the instant invention is to deliver higher proportions of anionic surfactant in the adsorbed layer at the solid-water interface. This is due to a boosted adsorption tendency and a closer 2-D packing by means of neutralization between the negative charge of the anionic surfactant and the positive charge of the zwitterionic surfactant that is used in admixture with the anionic surfactant in the instant compositions. Two anionic surfactants can be used in composition wherein one of the anionic surfactants will possibly preferentially associate with the zwitterionic surfactant through electrostatic interactions. If two anionic surfactants are present, there could be a hydrophilic-lipophilic interaction between the two anionic surfactants which will contributes to the 2-D packing at the solid-water interface. At optimized surface packing there is minimum interfacial tension that arises from maximum adhesion tension measured at the wetting line between the surfactant containing liquid composition and the solid surface. The instant liquid compositions exhibit an adhesion tension at 1 gram of the liquid composition/liter of water on shiny and flat solid layer of tripalmitin (glycerol tripalmitate) at 25° C. of higher than 18 mN/m, more preferably higher than 20 mN/m and most preferably higher than 21 mN/m.

As well known in the art adhesion tension is defined as the net force exerted by a solid on a liquid at the wetting line and depends upon the contact angle θ which the liquid makes on the solid substrate at the equilibrium. The adhesion tension is defined as the cosine of the contact angle θ that the liquid composition makes with the substrate times the surface tension of the liquid composition $\gamma_L$ as measured at 25° C. on a weakly polar solid substrate which is glycerol tripalmitate. The liquid compositions of the instant invention exhibit a minimum adhesion tension of 17 mN/m, more preferably 18 mN/m and most preferably 19 mN/m as measured at 25° C. for 1 grams of the liquid composition/liter of water on a solid layer of glycerol tripalmitate. Wetting of the substrate increases as the adhesion tension increases.

The wetting parameter (mN/m) of the liquid composition is defined as $\gamma_L$ (1-cosθ) measured at 25° C. for 1 gram of the liquid composition per one liter of water as measured on glycerol tripalmitate. The wetting parameter is linked to the propensity of the liquid composition to spread onto the substrate. The lower the value of the wetting parameter, the lower the interfacial tension at the glycerol tripalmitate-water interface. The wetting parameter of the instant compositions measured in said conditions has a value of less than 15 mN/m, more preferably less than 11 mN/m and most preferably less than 7 mN/m.

The contact angle of the instant liquid composition at a concentration of one gram/liter of water as measured at 25° C. on shiny and flat glycerol tripalmitate substrate are less than 60°, more preferably less than 50° and most preferably less than 45°.

According to the present invention, the role of the hydrocarbon is provided by a non-water-soluble perfume. Typically, in aqueous based compositions the presence of a solubilizers, such as alkali metal lower alkyl aryl sulfonate hydrotrope, triethanolamine, urea, etc., is required for perfume dissolution, especially at perfume levels of 1% and higher, since perfumes are generally a mixture of fragrant essential oils and aromatic compounds which are generally not water-soluble. Therefore, by incorporating the perfume into the aqueous cleaning composition as the oil (hydrocarbon) phase of the ultimate o/w microemulsion composition, several different important advantages are achieved.

First, the cosmetic properties of the ultimate cleaning composition are improved: the compositions are both clear (as a consequence of the formation of a microemulsion) and highly fragranced (as a consequence of the perfume level).

Second, the need for use of solubilizers, which do not contribute to cleaning performance, is eliminated.

Third, an improved grease release effect and an improved grease removal capacity in neat (undiluted) usage of the dilute aspect or after dilution of the concentrate can be obtained without detergent builders or buffers or conventional grease removal solvents at neutral or acidic pH and at low levels of active ingredients while improved cleaning performance can also be achieved in diluted usage.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight. The essential oils themselves are volatile odoriferous compounds and also serve to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The hydrocarbon such as a perfume is present in the hard surface cleaning composition in an amount of from 0 to 10% by weight, preferably 0.4% to 10% by weight, more preferably from 0.4% to 3.0% by weight, especially preferably from 0.5% to 2.0% by weight. If the hydrocarbon (perfume) is added in amounts more than 10% by weight, the cost is increased without any additional cleaning benefit and, in fact, with some diminishing of cleaning performance insofar as the total amount of greasy or oily soil which can be taken up in the oil phase of the microemulsion will decrease proportionately.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which includes less than 20%, usually less than 30%, of such terpene solvents.

Thus, merely as a practical matter, based on economic consideration, the microemulsion compositions of the present invention may often include as much as 0.2% to 7% by weight, based on the total composition, of terpene solvents introduced thereunto via the perfume component. However, even when the amount of terpene solvent in the cleaning formulation is less than 1.5% by weight, such as up to 0.6% by weight or 0.4% by weight or less, satisfactory grease removal and oil removal capacity is provided by the inventive diluted microemulsions.

Thus, for a typical formulation of a diluted microemulsion according to this invention a 20 milliliter sample of microemulsion containing 1% by weight of perfume will be able to solubilize, for example, up to 2 to 3 ml of greasy and/or oily soil, while retaining its form as a microemulsion, regardless of whether the perfume contains 0%, 0.1%, 0.2%, 0.3%, 0.4%, 0.5%, 0.6%, 0.7% or 0.8% by weight of terpene solvent.

In place of the perfume one can employ a water insoluble paraffin or isoparaffin having 6 to 18 carbon at a concentration of 0 to 8 wt. percent, preferably 0.4 to 8.0 wt. percent, more preferably 0.4 to 3.0 wt. %.

The analephotropic negatively charged complex contained in the instant compositions comprises a complex of:

(a) at least one anionic surfactant which is an alkali metal salt or an alkaline earth metal salt of a sulfonate or sulfate surfactant; and (b) an amine oxide, zwitterionic surfactant or an alkylene carbonate, wherein the ratio of the anionic surfactant to the zwitterionic surfactant or amine oxide is 4:1 to 0.2:1, more preferably 2.5:1 to 0.4:1 and the ratio of the anionic surfactant to the alkylene carbonate is 7:1 to 1.2:1. The instant composition contains about 3 to about 40 wt. %, more preferably about 5 to about 20 wt. % of the analephotropic negatively charged complex.

Suitable water-soluble non-soap, anionic surfactants include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble detergent. Usually, the hydrophobic group will include or comprise a $C_8$–$C_{22}$ alkyl, alkyl or acyl group. Such surfactants are employed in the form of water-soluble salts and the salt-forming cation usually is selected from the group consisting of sodium, potassium, or magnesium, with the sodium and magnesium cations again being preferred.

Examples of suitable sulfonated anionic surfactants are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3-(or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred olefin sulfonates contain from 14 to 16 carbon atoms in the R alkyl group and are obtained by sulfonating an a-olefin.

Other examples of suitable anionic sulfonate surfactants are the paraffin sulfonates containing 10 to 20, preferably 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

Examples of satisfactory anionic sulfate surfactants are the $C_8$–$C_{18}$ alkyl sulfate salts and the $C_8$–$C_{18}$ alkyl sulfate salts and the $C_8$–$C_{18}$ alkyl ether polyethenoxy sulfate salts having the formula $R(OC_2H_4)_n\ OSO_3M$ wherein n is 1 to 12, preferably 1 to 5, and M is a metal cation selected from the group consisting of sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product.

On the other hand, the alkyl ether polyethenoxy sulfates are obtained by sulfating the condensation product of ethylene oxide with a $C_8$–$C_{18}$ alkanol and neutralizing the resultant product. The alkyl sulfates may be obtained by sulfating the alcohols obtained by reducing glycerides of coconut oil or tallow or mixtures thereof and neutralizing the resultant product. On the other hand, the alkyl ether polyethenoxy sulfates are obtained by sulfating the condensation product of ethylene oxide with a $C_8$–$C_{18}$ alkanol and neutralizing the resultant product. The alkyl ether polyethenoxy sulfates differ from one another in the number of moles of ethylene oxide reacted with one mole of alkanol. Preferred alkyl sulfates and preferred alkyl ether polyethenoxy sulfates contain 10 to 16 carbon atoms in the alkyl group.

The $C_8$–$C_{12}$ alkylphenyl ether polyethenoxy sulfates containing from 2 to 6 moles of ethylene oxide in the molecule also are suitable for use in the inventive compositions. These surfactants can be prepared by reacting an alkyl phenol with 2 to 6 moles of ethylene oxide and sulfating and neutralizing the resultant ethoxylated alkylphenol.

Other suitable anionic surfactants are the $C_9$–$C_{15}$ alkyl ether polyethenoxyl carboxylates having the structural formula $R(OC_2H_4)_nOX\ COOH$ wherein n is a number from 4 to 12, preferably 5 to 10 and X is selected from the group consisting of $CH_2$, $(C(O)R_1$ and

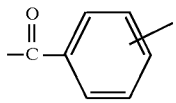

wherein $R_1$ is a $C_1$–$C_3$ alkylene group. Preferred compounds include $C_9$–$C_{11}$ alkyl ether polyethenoxy (7–9) C(O) $CH_2CH_2COOH$, $C_{13}$–$C_{15}$ alkyl ether polyethenoxy (7–9)

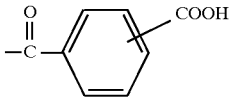

and $C_{10}$–$C_{12}$ alkyl ether polyethenoxy (5–7) CH2COOH. These compounds may be prepared by considering ethylene oxide with appropriate alkanol and reacting this reaction product with chloracetic acid to make the ether carboxylic acids as shown in U.S. Pat. No. 3,741,911 or with succinic anhydride or phthalic anhydride. Obviously, these anionic surfactants will be present either in acid form or salt form depending upon the pH of the final composition, with salt forming cation being the same as for the other anionic surfactants.

Of the foregoing non-soap anionic surfactants used in forming the analephotropic complex, the preferred surfactants are the sodium or magnesium salts of the $C_8$–$C_{18}$ alkyl sulfates such as magnesium lauryl sulfate and sodium lauryl sulfate and mixtures thereof.

Generally, the proportion of the nonsoap-anionic surfactants will be in the range of 0.1% to 30%, preferably from 1% to 15% by weight of the cleaning composition.

The instant composition contains about 3 to about 30 wt. %, preferably about 5 to about 15 wt. % of an amine oxide, zwitterionic surfactant or an alkylene carbonate.

The alkylene carbonates are depicted by the following formula:

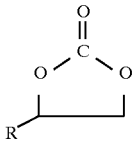

wherein R is an alkyl group having about 4 to about 14 carbon atoms, more preferably about 6 to about 10 carbon atoms.

The amine oxides used in forming the analephotropic complex are depicted by the formula

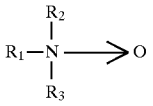

wherein $R_1$ is a $C_{10}$–$C_{18}$ a linear or branched chain alkyl group, $R_2$ is a $C_1$–$C_{16}$ linear alkyl group and $R_3$ is a $C_1$–$C_{16}$ linear alkyl group.

The zwitterionic surfactant used in forming the analephotropic complex is a water soluble betaine having the general formula

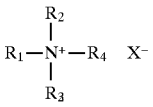

wherein $X^-$ is selected from the group consisting of $COO^-$ and $SO_3^-$ and $R_1$ is an alkyl group having 10 to about 20 carbon atoms, preferably 12 to 16 carbon atoms, or the amido radical:

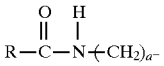

wherein R is an alkyl group having about 9 to 19 carbon atoms and a is the integer 1 to 4: $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N,N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine. Three preferred betaine surfactants are Genagen CAB and Rewoteric AMB 13 and Golmschmidt Betaine L7.

A cosurfactant can be optionally used in forming the microemulsion composition. Three major classes of compounds have been found to provide highly suitable cosurfactants over temperature ranges extending from 5° C. to 43° C. for instance; (1) water-soluble $C_3$–$C_4$ alkanols, polyethylene glycols of the formula $HO(CH_2CH_2O)nH$ wherein n is about 8 to about 14, polypropylene glycol of the formula $HO(CH_3CHCH_2O)_nH$ wherein n is a number from 2 to 18 and copolymers of ethylene oxide and propylene oxide and mono $C_1$–$C_6$ alkyl ethers and esters of ethylene glycol and propylene glycol having the structural formulas $R(X)_nOH$ and $R_1(X)_nOH$ wherein R is $C_1$–$C_6$ alkyl, $R_1$ is $C_2$–$C_4$ acyl group, X is $(OCH_2CH_2)$ or $(OCH_2\ (CH_3)CH)$ and n is a number from 1 to 4; (2) aliphatic mono- and di-carboxylic acids containing 2 to 10 carbon atoms, preferably 3 to 6 carbons in the molecule; and (3) triethyl phosphate. Additionally, mixtures of two or more of the three classes of cosurfactant compounds may be employed where specific pH's are desired.

When the mono- and di-carboxylic acid (Class 2) cosurfactants are employed in the instant microemulsion compositions at a concentration of 2 to 10 wt. %, the microemulsion compositions can be used as a cleaners for bathtubs and other hard surfaced items, which are acid resistant thereby removing lime scale, soap scum and greasy soil from the surfaces of such items damaging such surfaces. If these surfaces are of zirconium white enamel, they can be damaged by these compositions.

An aminoalkylene phophoric acid at a concentration of 0.01 to 0.2 wt. % can be optionally used in conjunction with the mono- and di-carboxylic acids, wherein the aminoalkylene phosphoric acid helps prevent damage to zirconium white enamel surfaces. Additionally, 0.05 to 1% of phosphoric acid can be used in the composition.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), propylene glycol monomethyl ether, dipropylene glycol monomethyl ether, triethylene glycol monobutyl ether, mono, di, tri propylene glycol monobutyl ether, tetraethylene glycol monobutyl ether, propylene glycol tertiary butyl ether, ethylene glycol monoacetate and dipropylene glycol propionate.

Representative members of the aliphatic carboxylic acids include $C_3$–$C_6$ alkyl and alkenyl monobasic acids such as acrylic acid and propionic acid and dibasic acids such as glutaric acid and mixtures of glutaric acid with adipic acid and succinic acid, as well as mixtures of the foregoing acids.

While all of the aforementioned glycol ether compounds and acid compounds provide the described stability, the most preferred cosurfactant compounds of each type, on the basis of cost and cosmetic appearance (particularly odor), are diethylene glycol monobutyl ether and a mixture of adipic, glutaric and succinic acids, respectively. The ratio of acids in the foregoing mixture is not particularly critical and can be modified to provide the desired odor. Generally, to maximize water solubility of the acid mixture glutaric acid, the most water-soluble of these three saturated aliphatic dibasic acids, will be used as the major component.

Generally, weight ratios of adipic acid: glutaric acid:succinic acid is 1-3:1-8:1-5, preferably 1-2:1-6:1-3, such as 1:1:1, 1:2:1, 2:2:1, 1:2:1.5, 1:2:2, 2:3:2, etc. can be used with equally good results.

Still other classes of cosurfactant compounds providing stable microemulsion compositions at low and elevated temperatures are the mono-, di- and triethyl esters of phosphoric acid such as triethyl phosphate.

The amount of cosurfactant which might be required to stabilize the microemulsion compositions will, of course, depend on such factors as the surface tension characteristics of the cosurfactant, the type and amounts of the analephotropic complex and perfumes, and the type and amounts of any other additional ingredients which may be present in the composition and which have an influence on the thermodynamic factors enumerated above. Generally, amounts of cosurfactant in the range of from 0 to 50 wt. %, preferably from 0.5 wt. % to 15 wt. %, especially preferably from 1 wt. % to 7 wt. %, provide stable microemulsions for the above-described levels of primary surfactants and perfume and any other additional ingredients as described below.

As will be appreciated by the practitioner, the pH of the final microemulsion will be dependent upon the identity of the cosurfactant compound, with the choice of the cosurfactant being effected by cost and cosmetic properties, particularly odor. For example, microemulsion compositions which have a pH in the range of 1 to 10 may employ either the class 1 or the class 4 cosurfactant as the sole cosurfactant, but the pH range is reduced to 1 to 8.5 when the polyvalent metal salt is present. On the other hand, the class 2 cosurfactant can only be used as the sole cosurfactant where the product pH is below 3.2. However, where the acidic cosurfactants are employed in admixture with a glycol ether cosurfactant, compositions can be formulated at a substantially neutral pH (e.g., pH 7±1.5, preferably 7±0.2).

The ability to formulate neutral and acidic products without builders which have grease removal capacities is a feature of the present invention because the prior art o/w microemulsion formulations most usually are highly alkaline or highly built or both.

The final essential ingredient in the inventive hard surface cleaning compositions having improved interfacial tension properties is water. The proportion of water in the microemulsion compositions generally is in the range of 20 wt. % to 97 wt. %, preferably 70 wt. % to 97 wt. % of the usual diluted o/w microemulsion composition.

The present invention also relates to a stable concentrated microemulsion or acidic microemulsion composition comprising approximately by weight:

(a) 3 to 40% of an analephotropic negatively charged complex as previously herein defined;

(b) 0 to 2.5% of a fatty acid;

(c) 2 to 30% of a cosurfactant;

(d) 0.4 to 10% of a water insoluble hydrocarbon or perfume;

(e) 0 to 18% of at least one dicarboxylic acid;

(f) 0 to 1% of phosphoric acid;

(g) 0 to 0.2% of an aminoalkylene phosphoric acid;

(h) 0 to 15% of magnesium sulfate heptahydrate; and (i) the balance being water.

The instant compositions excluded the use of ethoxylated nonionic surfactants formed for the condensation product of primary or secondary alkanols and ethylene oxide or propylene oxides because the use of these ethoxylated nonionic would cause a weakening of the chemical association between the chemical linker and anionic surfactant.

The present invention also relates to a light duty liquid composition or light duty liquid microemulsion composition which comprises approximately by weight:

(a) 3% to 40% of the previously defined analephotropic negative charged complex;

(b) 0 to 10% of a perfume, an essential oil or a water insoluble hydrocarbon;

(c) 0 to 25% of a cosurfactant; and (d) the balance being water.

The instant compositions excluded the use of ethoxylated nonionic surfactants formed for the condensation product of primary or secondary alkanols and ethylene oxide or propylene oxides because the use of these ethoxylated nonionic would cause a weakening of the chemical association between the chemical linker and anionic surfactant.

In addition to the above-described essential ingredients required for the formation of the all purpose cleaning or microemulsion composition, the compositions of this invention may often and preferably do contain one or more additional ingredients which serve to improve overall product performance.

One such ingredient is an inorganic or organic salt of oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level.

Thus, depending on such factors as the pH of the system, the nature of the analephotropic complex and cosurfactant, as well as the availability and cost factors, other suitable polyvalent metal ions include aluminum, copper, nickel, iron, calcium, etc. It should be noted, for example, that with the preferred paraffin sulfonate anionic detergent calcium salts will precipitate and should not be used. It has also been found that the aluminum salts work best at pH below 5 or when a low level, for example 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

The proportion of the multivalent salt generally will be selected so that at the appropriate weight ratio between the anionic surfactant and the zwitterionic surfactant, amine oxide or alkylene carbonate to deliver desired performance from the analephotropic surfactant mixture in terms of adsorption properties on grease surface, the physical stability of the total composition is kept, that can be impaired due to an increased hydrophobicity of the analephotropic complex in the presence of multivalent salt instead of alkali metal cation such as the sodium salt thereof. As a consequence, the proportion of the multivalent salt will be selected so that the added quantity will neutralize from 0.1 to 1.5 equivalents of the anionic surfactant, preferably 0.9 to 1.4 equivalents of the acid form of the anionic surfactant. At higher concentrations of anionic surfactant, the amount of multivalent salt will be in range of 0.5 to 1 equivalents per equivalent of anionic surfactant.

The hard surface cleaning compositions can optionally include from 0 to 2.5 wt. %, preferably from 0.1 wt. % to 2.0 wt. % of the composition of a $C_8$–$C_{22}$ fatty acid or fatty acid soap as a foam suppressant. The addition of fatty acid or fatty acid soap provides an improvement in the rinseability of the composition whether applied in neat or diluted form. Generally, however, it is necessary to increase the level of cosurfactant to maintain product stability when the fatty acid or soap is present. If more than 2.5 wt. % of a fatty acid is used in the instant compositions, the composition will become unstable at low temperatures as well as having an objectionable smell.

As example of the fatty acids which can be used as such or in the form of soap, mention can be made of distilled coconut oil fatty acids, "mixed vegetable" type fatty acids (e.g. high percent of saturated, mono-and/or polyunsaturated $C_{18}$ chains); oleic acid, stearic acid, palmitic acid, eiocosanoic acid, and the like, generally those fatty acids having from 8 to 22 carbon atoms being acceptable.

The all-purpose liquid cleaning or microemulsion composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

In final form, the all-purpose cleaning or clear microemulsions exhibit stability at reduced and increased temperatures. More specifically, such compositions remain clear and stable in the range of 40° C. to 50° C., especially 10° C. to 43° C. Such compositions exhibit a pH in the acid or neutral range depending on intended end use. The liquids are readily pourable and exhibit a viscosity in the range of 6 to 60 milliPascal Second (mPas.) as measured at 25° C. with a Brookfield RVT Viscometer using a #1 spindle rotating at 20 RPM. Preferably, the viscosity is maintained in the range of 10 to 40 mPas.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

When intended for use in the neat form, the liquid compositions can be packaged under pressure in an aerosol container or in a pump-type sprayer for the so-called spray-and-wipe type of application.

Because the compositions as prepared are aqueous liquid formulations and since no particular mixing is required to form the all purpose cleaning or microemulsion compositions, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume. The magnesium salt, or other multivalent metal compound, when present, can be added as an aqueous solution thereof or can be added directly. It is not necessary to use elevated temperatures in the formation step and room temperature is sufficient.

The instant all purpose cleaning or microemulsion composition explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

The instant compositions explicitly exclude the use of either a nonionic surfactant or an alkyl polyglucoside surfactant both of which, if added to the composition containing the analephotropic complex, can cause the composition to exhibit a decrease in oil-kaolin particulate soil removal as compared to a composition containing the analephotropic complex which does not contain a nonionic surfactant or an alkyl polyglucoside surfactant.

It is contemplated within the scope of the instant invention that the instant analephotropic negatively charged complex can be employed in hard surface cleaning compositions such as wood cleaners, window cleaners and light duty liquid cleaners.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared:

| Raw Materials | A | B | C | D | E | F | G |
|---|---|---|---|---|---|---|---|
| Sodium paraffin sulfonate $C_{14}$–$C_{17}$ (60%) | 4.0 | 4.0 | — | — | 3.5 | — | — |
| Sodium lauryl sulfate (99%) | — | — | 1.68 | — | — | 0.6 | — |
| NaAEOS (1.3:1) (26.54%) | — | — | — | — | — | — | 5.0 |
| Magnesium lauryl sulfate (99%) | — | — | 1.68 | — | — | 0.6 | — |
| MgAEOS (2:1) (70%) | — | — | — | 3.36 | — | — | — |
| MgLAS (43.7%) | — | — | — | — | — | — | 10.0 |

-continued

| Raw Materials | A | B | C | D | E | F | G |
|---|---|---|---|---|---|---|---|
| Cocoamido propyl betaine (30%) | — | — | 2.24 | — | 3.5 | 0.8 | 5.0 |
| Coco Dimethyl Betaine (30%) | — | — | — | 2.24 | — | — | — |
| Plurafac LF400 | 3.0 | 3.0 | — | — | — | — | — |
| DEGMBE | 3.5 | — | — | — | — | — | 11.2 |
| Coco Fatty Acid | 0.5 | — | — | — | — | — | — |
| $MgSO_4.7H_2O$ | 1.5 | 1.5 | — | — | 0.66 | — | — |
| Perfume | 0.8 | — | — | — | — | — | 2.4 |
| Minors | 0.2 | — | — | — | — | — | — |
| Water | Bal. | Bal. | Bal. | Bal. | Bal. | Bal. | Bal. |

Compositions A and B are commercially available Ajax references.

Cleaning performance were performed at 25° C. on Samples A–F

| Tests | A | B | C | D | E | F |
|---|---|---|---|---|---|---|
| % Particulate soil removal "CTTN" soil[a] | 86 | 85 | — | — | — | — |
| % Particulate soil removal "Kaolin" soil[b] | 42 | — | 72 | — | 41 | — |
| Diluted degreasing index[c] | 100 | — | 66 | — | — | — |
| Grease release (TP/NTP)[d] | — | — | — | — | — | 0.32 ± 0.06 |

(a) "CTTN" particulate soil composition: 70 g mineral oil, 35 g particulate soil (vacuum cleaner dust+1% carbon black) and 35 g tetrachloroetylene as solvent carrier (tetrachloroethylene is removed in an oven at 80° C. prior to run the test). The vacuum cleaner dust of particulate size distribution from 80 to 160 microns is provided by CTTN-IREN Institute (France) and is known as "CTTN" soil.

(b) Kaolin particulate soil composition: 70 g mineral oil, 35 g kaolin and 35 g tetrachloroethylene as solvent carrier (tetrachloroethylene is removed in an oven at 80° C. prior to run the test). Kaolin is medium particle size china clay from ECC International—grade E powder—65% minimum below 10 microns, with 0.05% maximum above 53 microns.

(c) Degreasing performance at a concentration of 12 g/l in tap water. Ceramic tiles are soiled with sprayed hot melted grease. The grease is a mix of 80% beef tallow and 20% hydrogenated tallow (Radia 3059 from Oleofina) and 0.05% fat blue dye. The score of Ajax Regular composition (A) is taken as reference (100) and index score is calculated for each tested composition.

(d) Grease release is evaluated through the easiness to remove soil from a treated tile (TP) versus a nontreated tile (NTP). The lower the number the better the grease release effect.

EXAMPLE 2

The following compositions in wt. % were prepared:

| Raw Materials | A | B | C | D | E | F | G | H | I |
|---|---|---|---|---|---|---|---|---|---|
| Sodium lauryl sulfate (99%) | 1.4 | 5.25 | 5.25 | — | — | — | 5.25 | 9.2 | 6.3 |
| NaAEOS (1.3:1) (26.54%) | — | — | — | — | — | 5.0 | — | — | — |
| Magnesium lauryl sulfate (99%) | 2.8 | 10.5 | 10.5 | — | — | — | — | 9.2 | 6.3 |
| MgAEOS (2:1) (70%) | — | — | — | — | — | — | 10.5 | — | — |
| Linear alkyl benzene sulfonate C9–C13 Na salt (52%) | — | — | — | 7.0 | 5.25 | — | — | — | — |
| Linear alkyl benzene sulfonate C9–C13 Mg salt (43.7%) | — | — | — | — | 10.5 | 10.0 | — | — | — |
| Cocoamido propyl betaine (30%) | 1.4 | 5.25 | 5.25 | — | 5.25 | 5.0 | 5.25 | 12.3 | 8.4 |
| DEGMBE | — | 5.0 | — | — | 15 | 11.2 | — | 19.1 | 7.4 |
| DPM | | — | 5.0 | — | — | — | 5.0 | — | — |
| Perfume | — | 2.4 | 2.4 | — | 2.4 | 2.4 | 2.4 | — | 2.4 |
| Water | Bal. | Bal. | Bal. | Bal. | Bal. | Bal. | Bal. | Bal. | Bal. |
| Physical stability | | | | | | | | | |
| RT | Yes | Yes | Yes | Yes | Yes | Yes | Yes | Yes | Yes |
| 4° C. | — | Yes | Yes | Yes | no | Yes | Yes | Yes | Yes |

Cleaning performance were performed at 25° C. on Samples A–G

| Test[a] | A | B | C | D | E | F | G |
|---|---|---|---|---|---|---|---|
| % Particulate Soil Removal "Kaolin" soil[b] | 90 | 84 | 92 | 77 | 56 | 98 | 87 |

a) Compositions B-C-E-F-G are three times concentrated. They are evaluated for particulate soil removal performance in three times diluted form for having the same level of active ingredients as with other compositions.

b) Kaolin particulate soil composition: 70 g mineral oil, 35 g kaolin and 35 g tetrachloroethylene as solvent carrier (tetrachloroethylene is removed in an oven at 80° C. prior to run the test). Kaolin is medium particle size china clay from ECC International—grade E powder—65% minimum below 10 microns, with 0,05% maximum above 53 microns.

EXAMPLE 3

The following compositions in wt. % were prepared:

| Raw Materials | A | B | C | D |
|---|---|---|---|---|
| Linear alkyl benzene sulfonate C9–C13 Na salt (52%) | 5.8 | 5.6 | 6.38 | 5.43 |
| C8AKC[a] | 1.2 | 1.4 | — | — |
| C12AKC[b] | — | — | 0.62 | 1.57 |
| DEGMBE | — | 4.6 | — | — |
| DPM | — | — | — | 3.5 |
| Perfume | — | 0.8 | — | — |
| Water | Bal. | Bal. | Bal. | Bal. |
| Physical stability | | | | |
| RT | Yes | Yes | Yes | Yes |
| 4° C. | no | Yes | Yes | no |

[a]$C_8$AKC is $C_8$ alkylene carbonate, or 1,2-octanediol carbonate.
[b]$C_{12}$AKC is $C_{12}$ alkylene carbonate, or 1,2-dodecanediol carbonate.

Cleaning performance were performed at 25° C. on Samples A–D

| Test | A | B | C | D |
|---|---|---|---|---|
| % Particulate Soil Removal "Kaolin" soil[a] | 45 | — | 79 | 98 |

[a]Kaolin particulate soil composition: 70 g mineral oil, 35 g kaolin and 35 g tetrachloroethylene as solvent carrier (tetrachloroethylene is removed in an oven at 80° C. prior to run the test). Kaolin is medium particle size china clay from ECC International - grade E powder - 65% minimum below 10 microns, with 0,05% maximum above 53 microns.

EXAMPLE 4

The following compositions in wt. % were prepared.

| Raw Materials | A | B | C | D | E | F | G |
|---|---|---|---|---|---|---|---|
| Sodium lauryl sulfate | 10 | | | | | 3 | |
| Linear alkyl benzene sulfonate (LAS) C9–C13 Na salt | | 10 | | | | | 5 |
| Magnesium lauryl sulfate | | | 4 | | 5 | 3 | |
| Cocoamido propyl betaine | | | | 5 | 5 | 4 | 5 |
| Water | Bal. | Bal. | Bal. | Bal. | Bal. | Bal. | Bal. |
| Adhesion tension (a) | 0.5 | 13.2 | 12.5 | 15.3 | 18.4 | 20.0 | 18.5 |
| Contact angle (a) | 89° | 68° | 67° | 61° | 45° | 40° | 48° |

(a) adhesion tension and contact angle measured at a concentration of 1 gram of surfactant per liter of water at 25° C. on glycerol tripalmitate.

EXAMPLE 5

The following compositions in wt. % were prepared.

| Raw Materials | A | B | C | D | E | F | G | H | I | J |
|---|---|---|---|---|---|---|---|---|---|---|
| Paraffin sulphonate C14–C17 Na salt | 10 | | | | | 5 | 5 | 5 | 2.52 | 2.52 |
| Cocoamido propyl betaine | | 5 | | | | 5 | | | | |
| Cocodimethyl betaine | | | 5 | | | | 5 | | | |
| Lauryl dimethyl amine oxide | | | | 5 | | | | 5 | | |
| N-octyl pyrrolidone (HCl) | | | | | 1.4 | | | | 1.48 | 1.48 |
| $MgSO_4.7H_2O$ | | | | | | | | | | 0.95 |
| Water | Bal. | Bal. | Bal. | Bal. | Bal. | Bal. | Bal. | Bal. | Bal. | Bal. |
| Adhesion tension (a) | 15.8 | 15.3 | 15.4 | 20.2 | 19.1 | 18.2 | 18.5 | 21.3 | 19.3 | 21.2 |
| Contact angle (a) | 61° | 61° | 61° | 48° | 49° | 53° | 43° | 32° | 48° | 35° |

(a) adhesion tension and contact angle measured at a concentration of 1 gram of surfactant per liter of water at 25° C. on glycerol tripalmilate.

In summary, the described invention broadly relates to an improvement in all purpose cleaning or microemulsion compositions containing an analephotropic negatively charged complex, a fatty acid, one of the specified cosurfactants, a hydrocarbon ingredient and water which can comprise the use of a water-insoluble, odoriferous perfume as the essential hydrocarbon ingredient in a proportion sufficient to form a dilute o/w microemulsion composition containing, by weight, 3% to 40% of an analephotropic negatively charged complex, 0% to 2.5% of a fatty acid, 0% to 50% of cosurfactant, 0 to 10% of perfume and the balance being water.

What is claimed:

1. A cleaning composition comprising approximately by weight:

(a) 1% to 15% of at least one anionic surfactant selected from the group consisting of alkali metal salts of sulfonates, alkali metal salts of sulfates, alkaline earth metal salts of sulfonates and alkaline earth metal salts of sulfates;

(b) 3% to 30% of a surfactant selected from the group consisting of an amine oxide surfactant and an alkylene carbonate said surfactant being complexed with said anionic surfactant in a molar ratio of said anionic surfactant to said amine oxide surfactant of about 4:1 to 0.4:1, and in a molar ratio of said anionic surfactant to said alkylene carbonate of about 7:1 to 1.2:1;

(c) about 0.5% to about 15% of a water soluble glycol ether or a $C_3$–$C_6$ aliphatic carboxylic acid cosurfactant;

(c) about 0 to about 10 wt. % of a water insoluble hydrocarbon or a perfume; and (d) the balance being water, wherein the composition does not contain an ethoxylated nonionic surfactant and has a pH of acid to neutral.

2. The cleaning composition of claim 1 which further contains a multivalent salt of a multivalent metal cation in an amount sufficient to provide from 0.5 to 1.5 equivalents of said cation per equivalent of said anionic surfactant, said multivalent cation being selected from the group consisting of magnesium, aluminum, copper, nickel, iron and calcium.

3. The cleaning composition of claim 2 wherein said multivalent salt is magnesium oxide or magnesium sulfate.

4. The cleaning composition of claim 1 further including 0.1 to 2 wt. % of a fatty acid which has 8 to 22 carbon atoms.

5. The cleaning composition of claim 1 which contains from 0.4% to 10% by weight of said hydrocarbon or said perfume.

6. The cleaning composition of claim 1 wherein the glycol ether is selected from the group consisting of ethylene glycol monobutylether, diethylene glycol monobutyl ether, triethylene glycol monobutylether, polypropylene glycol having an average molecular weight of from 200 to 1,000 and propylene glycol monomethyl ether, and dipropylene glycol monomethyl ether, and propylene glycol tertbutyl ether, mono, di, tri propylene glycol monobutyl ether.

7. The cleaning composition of claim 1 wherein the cosurfactant is said $C_3$–$C_6$ aliphatic carboxylic acid selected from the group consisting of acrylic acid, propionic acid, glutaric acid, mixtures of glutaric acid and succinic acid and adipic acid and mixtures of any of the foregoing.

8. The cleaning composition of claim 1 wherein the anionic surfactant is a $C_9$–$C_{15}$ alkyl benzene sulfonate or a $C_{10}$–$C_{20}$ alkane sulfonate.

9. A cleaning composition comprising approximately by weight:

(a) at least one anionic surfactant selected from the group consisting of alkali metal salts of sulfonates, alkali metal salts of sulfates, alkaline earth metal salts of sulfonates and alkaline earth metal salts of sulfates; and (b) 0.3% to 30% of a zwitterionic surfactant, being complexed with said anionic surfactant in a molar ratio of said anionic surfactant to said zwitterionic surfactant about 4:1 to 0.4:1;

(c) about 0.5% to about 15% of a water soluble glycol ether or a $C_3$–$C_6$ aliphatic carboxylic acid cosurfactant;

(d) about 0 to about 10 wt. % of a water insoluble hydrocarbon or a perfume; and (e) the balance being water, wherein the composition does not contain an ethoxylated nonionic surfactant and has a pH of acid to neutral.

10. The cleaning composition of claim 9 which further contains a salt of a multivalent metal cation in an amount sufficient to provide from 0.5 to 1.5 equivalents of said cation per equivalent of said anionic surfactant, said multivalent cation being selected from the group consisting of magnesium, aluminum, copper, nickel, iron and calcium.

11. The cleaning composition of claim 10 wherein said multivalent salt is magnesium oxide or magnesium sulfate.

12. The cleaning composition of claim 9 further including 0.1 to 2 wt. % of a fatty acid which has 8 to 22 carbon atoms.

13. The cleaning composition of claim 9 which contains from 0.1 to 50% by weight of said cosurfactant and from 0.4% to 10% by weight of said hydrocarbon.

14. The cleaning composition of claim 9 wherein the glycol ether is selected from the group consisting of ethylene glycol monobutylether, diethylene glycol monobutyl ether, triethylene glycol monobutylether, polypropylene glycol having an average molecular weight of from 200 to 1,000 and propylene glycol monomethyl ether, and dipropylene glycol monomethyl ether, and propylene glycol tertbutyl ether, mono, di, tri propylene glycol monobutyl ether.

15. The cleaning composition of claim 9 wherein the cosurfactant is said $C_3$–$C_6$ aliphatic carboxylic acid selected from the group consisting of acrylic acid, propionic acid, glutaric acid, mixtures of glutaric acid and succinic acid and adipic acid and mixtures of any of the foregoing.

16. The cleaning composition of claim 9 wherein the anionic surfactant is a $C_9$–$C_{15}$ alkyl benzene sulfonate or a $C_{10}$–$C_{20}$ alkane sulfonate.

* * * * *